US011226181B2

(12) United States Patent
Rastegar

(10) Patent No.: US 11,226,181 B2
(45) Date of Patent: Jan. 18, 2022

(54) HIGH EXPLOSIVE FRAGMENTATION MORTARS

(71) Applicant: Jahangir S Rastegar, Stony Brook, NY (US)

(72) Inventor: Jahangir S Rastegar, Stony Brook, NY (US)

(73) Assignee: OMNITEK PARTNERS, L.L.C., Ronkonkoma, NY (US)

( * ) Notice: Subject to any disclaimer, the term of this patent is extended or adjusted under 35 U.S.C. 154(b) by 0 days.

(21) Appl. No.: 15/912,537

(22) Filed: Mar. 5, 2018

(65) Prior Publication Data

US 2018/0252508 A1 Sep. 6, 2018

Related U.S. Application Data

(60) Provisional application No. 62/467,793, filed on Mar. 6, 2017.

(51) Int. Cl.
*F42B 12/32* (2006.01)
*F42B 12/24* (2006.01)
*F42B 10/38* (2006.01)

(52) U.S. Cl.
CPC ..... *F42B 12/32* (2013.01); *F42B 10/38* (2013.01); *F42B 12/24* (2013.01)

(58) Field of Classification Search
CPC ..... F42B 12/32; F42B 12/24; F42B 12/22; F42B 30/10; F42B 30/12; F42B 8/20
USPC ..... 102/494
See application file for complete search history.

(56) References Cited

U.S. PATENT DOCUMENTS 3,181,465 A * 5/1965 Anthony ..... F42B 30/10 102/445
3,815,504 A * 6/1974 Tieben ..... F42B 12/32 102/496
3,882,779 A * 5/1975 Frostig ..... F42B 12/32 102/496
4,016,816 A * 4/1977 Larsson ..... C03C 25/12 102/494
4,365,560 A * 12/1982 Frostig ..... F42B 12/32 102/477
4,524,696 A * 6/1985 Altenau ..... F42B 12/32 102/473
4,644,867 A * 2/1987 Hellner ..... F42B 12/32 102/495

(Continued)

*Primary Examiner* — Joshua E Freeman

(57) ABSTRACT

A mortar shell including: a metallic inner layer; a polymer outer layer having reinforcing fibers dispersed therein; and at least one layer of metallic fragments disposed between the inner and outer layers, the layer of metallic fragments including a plurality of individual metallic fragments unconnected to each other. In a variation, the mortar shell including: a metallic inner layer, the metallic inner layer having a grid formed on an outer surface to define a plurality of metallic fragments separated by grooves; a polymer having first reinforcing fibers disposed within the grooves; and a polymer outer layer having second reinforcing fibers dispersed therein. In another variation, the mortar shell including a polymer outer layer having reinforcing fibers dispersed therein; and a metallic inner layer having a plurality of metallic fragments with a shape to interlock to each of the other and assembled together into the metallic inner layer.

4 Claims, 6 Drawing Sheets

(56) References Cited

U.S. PATENT DOCUMENTS

| | | | | |
|---|---|---|---|---|
| 4,936,217 | A * | 6/1990 | Hofmann | F42B 12/32<br>102/496 |
| 6,817,299 | B1 * | 11/2004 | Cooke | F42B 12/24<br>102/493 |
| 8,161,884 | B1 * | 4/2012 | Kokodis | F42B 12/24<br>102/476 |
| 9,410,781 | B1 * | 8/2016 | Hooke | F42B 14/067 |
| 2005/0087088 | A1 * | 4/2005 | Lacy | F42B 12/32<br>102/495 |
| 2009/0211484 | A1 * | 8/2009 | Truitt | F42B 12/50<br>102/497 |

* cited by examiner

HIGH EXPLOSIVE FRAGMENTATION MORTARS

CROSS-REFERENCE TO RELATED APPLICATION

This application claims the benefit of U.S. Provisional Application No. 62/467,793 filed on Mar. 6, 2017, the entire contents of which is incorporated herein by reference.

BACKGROUND OF THE INVENTION

1. Field of the Invention

The present invention relates generally to mortars, and more particularly to high explosive fragmentation mortars.

2. Prior Art

A mortar system by its very nature needs to be light weight, low cost, and maneuverable. This restricts the ability to fire at longer ranges with greater accuracy since firing range and accuracy are a function of the size and weight of the system. Advanced technologies and methodologies have emerged that show promise in optimizing the launch and flight conditions of the mortar system to provide a more efficient sequence of launch and flight events, e.g., ignition of propellant, expansion of propellant gasses, travel of the mortar round up and out of the tube, ballistic flight, and terminal impact. The aerodynamic and flight characteristics can be modified to increase range and precision.

The conventional material used to construct the shell body of high explosive mortar rounds are steel-based alloys, forged steel, and wrought carbon steel. These metallic casings exhibit high mechanical modules, such as strength, ductility, and durability, and are relatively high in density. Fragmentation of metallic casings can be fundamentally categorized into one of three methods: natural, controlled (or embossed), and preformed fragmentation. Natural fragmentation of steel shells results to irregular and predominantly smaller fragments with low damaging capabilities.

Embossed fragmentation of metallic shells can be engineered by machining a grid layer to be placed between an unimpaired casing and the high-explosive material.

The lethality of fragmentation can further be improved upon by creating a matrix of preformed fragments embedded into the casing, although the integrity of the shell body will be compromised under the high launch accelerations experienced during the firing phase. The RAUG Company (now SAAB) overcame these difficulties when they introduced the Mortar Anti-Personnel Anti-Materiel (MAPAM) 60 mm mortar in 2004. The MAPAM round featured an epoxy matrix filled with 2400 ball bearings, enclosed between the metallic shell body and high explosive material. The preformed fragments featured in the MAPAM mortar increased lethality of the round by as much as 70% over conventional rounds that were in service at the time.

By replacing the conventional metallic casing with composite-based material, the propulsion acceleration level is increased during the firing due to the reduction of the mortar shell mass. In addition, the lethality of projected fragments and their covered range can be significantly increased by making the fragments lighter, thereby achieving higher expulsion velocities, and more aerodynamically shaped, thereby reducing drag forces acting on the fragments.

Composites are fabricated by combining two or more materials of different structures and compositions to yield tailored properties controlled by the orientation of fiber elements. Therefore, composites are typically categorized as anisotropic with mechanical properties that differ based on the direction of applied load. The implementation of composite materials, such as carbon-fiber reinforced polymers, into shell casing structure have been studied and tested over the past two decades, with applications focused primarily on: (1) non-lethal mortars, or (2) low collateral damage artillery rounds.

A study was conducted to determine the feasibility of implementing high module composite materials to meet the demanding mechanical requirements exerted onto mortar casings during the launch phase of a munition's flight path. The objective of the study was to develop technologies to deliver non-lethal payloads to areas of interest by inducing a fuzed ignition during the flight of a mortar bomb via case fragmentation. To achieve fragmentation at lower detonation energy levels, a casing structure was designed to fragment into eight small carbon-fiber resin strips by pre-stressing the composite structure during the fabrication process. A controlled fragmentation pattern can thereby be achieved with the resulting shell structure. While polyacrylonitrile (PAN) carbon-fiber (Hexel AS4-C plain weave) was determined to be the material of choice for the fiber structure, two other types of matrix materials tested were West System 105/20 and Epoxy System 303. The pan-based fibers were surface treated to promote adhesion between the fiber and the matrix, consequently increasing the interlaminar shear strength of the final composite. A vacuum assisted resin transfer modeling technique (VARTM) was utilized to create eight small strips of laminated carbon-fiber reinforced polymer with reduced voids and controlled curvature. The strips were then assembled into a cylindrical shape using a casing mold to be cured. Compression testing showed that the fabricated structure was capable of withstanding 9200 g's, while finite element analysis showed the buildup of stress concentrations along the corners of the individual laminated strips to initiate the desired fragmentation pattern, i.e., to break apart into eight strip fragments.

Composite material with filament winding has also been used to fabricate a non-uniform exterior casing of munitions. The process was used with the objective of developing a low collateral damage artillery shell so as to fabricate a composite munition shell body that would disintegrate into harmless fibers upon impact.

In a similar manner, composite warhead cased general purpose bombs have been developed in which a list of parameters, such as fiber and matrix types, winding tensions and laid patterns, as well as curing conditions were studied, to create an optimized structure capable of withstanding the exterior conditions of an effective weapon. A carbon-fiber-wound bomb body disintegrates instead of fragmenting, which adds explosive force nearby, but lowers collateral damage.

SUMMARY OF THE INVENTION

High explosive fragmentation mortar embodiments are provided to significantly increase their range of coverage, accuracy, as well as their lethality.

A range extension for the mortars is achieved by reducing the total weight of the mortar bomb by replacing the conventional steel-based shell body with a multi-functional structure consisting of composite materials, such as those that include carbon-fiber reinforced polymers, and metallic formed fragmentation structures that are specifically configured to achieve the desired fragmentation patterns. In two embodiments, the metallic formed fragmentation layers are fully load bearing during the firing, thereby do not occupy extra space and/or increase the total mortar weight. Mortar exit velocity is increased using a lower friction obturating ring. The mortar range of coverage can be further increased by reducing aerodynamic drag during the flight using surface dimple patterns through the mechanism of inducing a turbulent boundary layer on the surface, a method that is commonly used in the design of golf balls. In addition, the dimple pattern can be configured such that the air flow pattern over the round surface would generate a desired net spinning torque to increase the round stability and precision. The multi-functional structure of the mortar shell also provides the means of integrating some of the components such as low power actuation devices into the structure to significantly reduce the required complexity and volume inside the round and thereby the potential of increasing its lethality and precision.

Features of the mortars disclosed herein include:

1. The embodiments can increase the range of coverage by: (a) reducing the weight of the mortar shell; (b) reducing drag forces during the flight; and/or (c) reducing the friction forces during the launch;

2. The lethality of the high explosive fragmentation mortar can be significantly increased by using preformed fragments that can be designed for high lethality and for reduced drag and enhanced stability—with possible induced spin—to increase their coverage and effectiveness;

3. The targeting precision can be increased by: (a) providing the round with asymmetric drag reducing shell surface dimple patterns to generate an aerodynamic spin torque without increasing drag; and/or (b) by providing the means of integrating many of the components into the structure of the mortar shell to free up space inside the mortar for increased lethality and targeting precision, such as low power actuation devices for terminal guidance applications;

4. The multi-functional shell structure embodiments combine the high strength and lightweight properties of carbon-fiber composites with novel load-bearing metallic formed fragmentation structures to yield a significantly lighter and lethal shell for high explosive fragmentation mortars, thereby significantly increasing the range. A 20-25% reduction in the mortar mass can result in an almost proportional increase in exit velocity with the same explosive charges;

Providing surface dimple patterns on the shell surface can reduce the aerodynamic drag on the round during the flight, thereby increasing its range and/or, by properly arranging the dimple patterns and their geometry, a desired net spinning torque can be generated, thereby providing the round with a desired spin rate the resulting stability and precision.

Accordingly, a mortar shell is provided. The mortar shell comprising: a metallic inner layer defining an interior of the mortar; a polymer outer layer, the polymer outer layer having reinforcing fibers dispersed therein; and at least one layer of metallic fragments disposed between the inner and outer layers, the at least one layer of metallic fragments comprising a plurality of individual metallic fragments which are unconnected to each other.

The polymer outer layer can comprise a plurality of concavities formed on an inner surface, the plurality of concavities corresponding to the plurality of individual metallic fragments such that at least a portion of each of the plurality of individual metallic fragments are disposed within a corresponding one of the plurality of concavities.

The mortar shell can further comprise a polymer inner layer disposed between the metallic inner layer and the at least one layer of metallic fragments. The polymer inner layer can comprise a plurality of concavities formed on an outer surface, the plurality of concavities corresponding to the plurality of individual metallic fragments such that at least a portion of each of the plurality of individual metallic fragments are disposed within a corresponding one of the plurality of concavities.

The polymer outer layer can comprises a plurality of concavities formed on an inner surface, the plurality of concavities corresponding to the plurality of individual metallic fragments such that at least a portion of each of the plurality of individual metallic fragments are disposed within a corresponding one of the plurality of concavities; and the mortar shell can further comprise a polymer inner layer disposed between the metallic inner layer and the at least one layer of metallic fragments, the polymer inner layer comprises a plurality of concavities formed on an outer surface, the plurality of concavities corresponding to the plurality of individual metallic fragments such that at least a portion of each of the plurality of individual metallic fragments are disposed within a corresponding one of the plurality of concavities.

At least some of the plurality of individual metallic fragments can be spherical in shape.

The polymer outer layer can comprise a pattern of dimples formed on an outer surface.

The polymer outer layer can comprise a solid lubricant.

Also provided is a mortar shell comprising: a metallic inner layer defining an interior of the mortar, the metallic inner layer having a grid formed on an outer surface to define a plurality of metallic fragments separated by grooves; a polymer having first reinforcing fibers disposed within the grooves; and a polymer outer layer, the polymer outer layer having second reinforcing fibers dispersed therein.

The grid can be a square grid to define square shaped metallic fragments.

The polymer outer layer can comprise a pattern of dimples formed on an outer surface.

The polymer outer layer can comprise a solid lubricant.

Still further provided is a mortar shell comprising: a polymer outer layer, the polymer outer layer having reinforcing fibers dispersed therein; and a metallic inner layer defining an interior of the mortar, the metallic inner layer having a plurality of metallic fragments, each of the plurality of metallic fragments having a shape to interlock to each of the other of the plurality of metallic fragments, the plurality of metallic fragments being assembled together into the metallic inner layer.

The polymer outer layer can comprise a pattern of dimples formed on an outer surface.

The polymer outer layer can comprise a solid lubricant.

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENT

Embodiments for mortars include features for increasing one or more of their range and precision as well as their lethality. The mortar shell construction also provides the capability of integrating (embedding) components, such as multi-pulse actuation devices directly into the shell body, thereby significantly reducing the complexity and the number of components needed for their assembly into the mortar body.

Carbon-Fiber Composite Shell with Integrated Formed Aerodynamic Fragments

As discussed above, the feasibility of using carbon-fiber composites to replace steel-based metals as munitions shells has been shown. Studies have found that artillery shell with a composite munition shell body disintegrates into harmless fibers upon detonation.

The properties of a typical carbon fiber composite material used in these studies together with the properties of conventional steel used in the construction of mortar shells are shown in Table 1. Note that the 0° and 90° represent normal and transverse loading, respectively. The critical stress that determines failure in munitions shell is tensile loading in the transverse direction which carbon fiber composite can only withstand 50 MPa before failing (under normal strain rates).

Composite materials are orthotropic materials, exhibiting high strength in the direction of fibers and low strength in the perpendicular direction. In general, by manipulating the design parameters such as fiber winding angles, fiber volumes, and the laminate thickness, the desired structural performance metric can be achieved. Shell structures have been widely used in commercial pressure vessel applications and the technology for their cost-effective fabrication is well developed.

TABLE 1

Comparison of conventional steel and M55 UD high modulus carbon-fiber.
Conventional and Carbon Fiber Materials for Mortar and Properties

| Material Properties | Conventional Steel | Carbon Fiber [0°/9°] (M55 UD) |
|---|---|---|
| Density (g/cm$^3$) | 7.88 | 1.91 |
| Elastic Modulus (GPa) | 210 | 300/12 |
| Tensile Strength (MPa) | 400-550 | 1600/50 |
| Compressive Strength (MPa) | 170-310 | 1300/250 |
| In-Plane Shear Modulus (GPa) | 74-82 | 5 |
| Poisson's Ratio | 0.29 | 0.3 |

Figure 1:
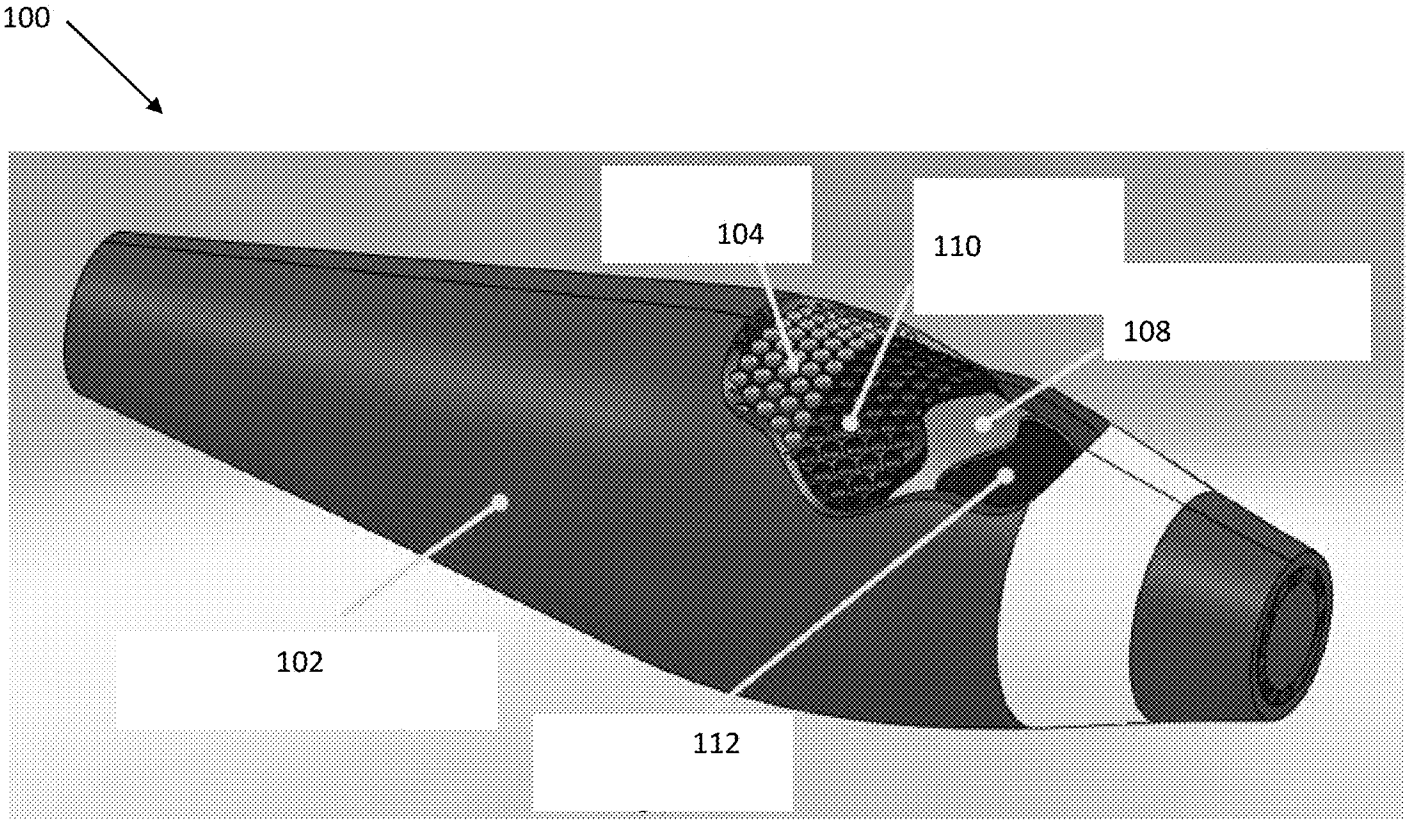
FIG. 1 illustrates an embodiment of a carbon-fiber composite shell with integrated formed aerodynamic fragments.

An embodiment of a carbon-fiber composite shell 100 with integrated formed aerodynamic fragments is shown in FIG. 1. In this concept, the outer layer 102 of the shell is constructed with carbon-fiber composite with pockets 106 (see FIGS. 2*a* and 2*b*) to accommodate one or more layers of solid preformed fragments 104, in the example of FIG. 1 the fragments 104 are solid balls and the pockets 106 are semi-circular shaped concavities so as to fit the solid balls within. The walls of the inner pockets also act as "diamond" shaped "ribs", FIGS. 2*a* and 2*b*, that gives the shell 100 strength to withstand the firing acceleration. A relatively thin inner skin 108, such as a thin 1 mm or thinner steel layer, is then provided to keep the preformed fragments 104 in position and to transfer the explosion generated pressure more effectively to the fragments 104. The gap between the inner thin steel layer 108 and the outer carbon-fiber composite shell 102 around the formed fragments 104 is filled with a casted composite material 110, which can consist mainly of short fibers of various types, such as glass or carbon fiber and the required binding resin. The inner thin steel layer 108 defines an interior space 112 of the mortar, for accommodating various components, such as explosive charges.

Figure 2B:
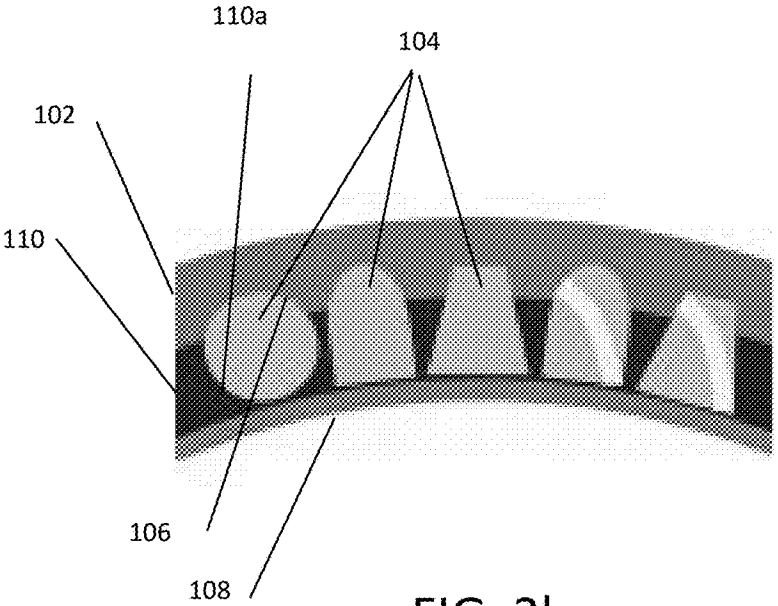
FIG. 2*a* illustrates a cross-sectional view of the carbon-fiber composite shell of FIG. 1 with integrated formed aerodynamic fragments and FIG. 2*b* illustrates a close-up view of several possible geometries for the fragments.

The combined strength of the integrated shell 100 for resisting internal pressure must be close to that of conventional material used to construct the shell body of high explosive mortar rounds, such as steel-based alloys, forged steel, and wrought carbon steel to ensure proper action of its explosive charges. The cross-sectional view of FIG. 2*b* shows the carbon-fiber composite shell 100 with its integrated formed aerodynamic fragments 104 of several exemplary geometries.

An objective in the optimal design of the formed fragment geometry is to maximize its range of travel upon mortar detonation. The range of travel of the formed fragments is dependent on its initial velocity upon expulsion and the aerodynamic drag induced decelerating force acting on it. To increase its initial velocity, the formed fragment must provide a large enough area against the explosion generated expanding gasses to act on, i.e., to increase the expulsion forces acting on the fragment, and must be low mass. These two requirements indicate that the formed fragments must be relatively thin elements with large surfaces of almost any shape, such as diamond shapes. However, such relatively large surface and thin formed fragments are aerodynamically high drag bodies and even though they start their travel with a high velocity, they would tumble and lose their kinetic energy rapidly due to large aerodynamic drag induced forces that their geometrical shape generates.

For the above reason, an optimal geometry for formed fragments can be a spherical shape. A hollow spherical shape made from strong and tough but lightweight material that can withstand the firing as well as the expulsion shock loadings can be used for the above reasons. Although ball shaped formed fragments have been used in the Mortar Anti-Personnel Anti-Materiel (MAPAM) 60 mm mortar (as discussed above), the method of assembling them in such round is less than ideal since by casting them in a binding resin would inevitably cause their expulsion with resin particles, thereby increasing the generated aerodynamic drag during their flight.

Figure 2A:
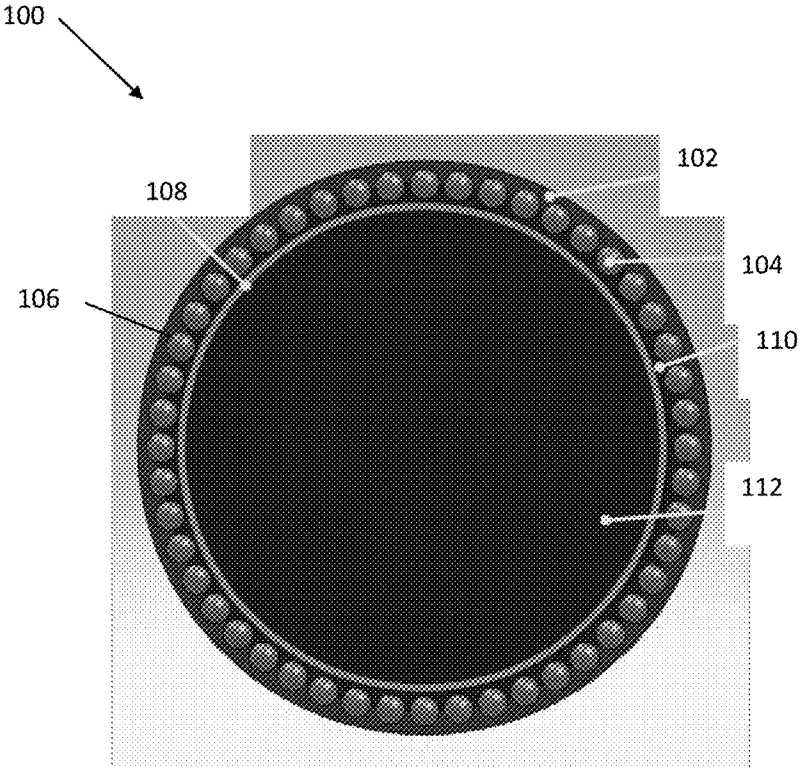

In the embodiment of FIG. 1 and the cross-sectional view of FIG. 2*a* only one layer of spherical formed fragments is shown. It is, however, appreciated that more than one such layer, and a combination of variously shaped formed fragments may also be used. Some examples of possible formed fragment geometries are shown in FIG. 7*b*. These and other possible geometrical shapes (see, e.g., FIGS. 4*a*-4*f*) can maximize the number of formed fragments per unit volume, particularly those that intermesh to provide a compressive load supporting structure to support firing shock loading and those that could also induce spin to affect stability.

The carbon-fiber composite shell 100 with integrated formed aerodynamic fragments 104 of FIG. 1 may be fabricated as follows. The first step includes casting the filling composite material 110, comprising mainly of short fibers of various types, such as glass or carbon fiber, over the inner steel layer 108 to provide pockets 110*a* for the formed fragments 104 of the desired types. The casting of the pocketed layer 110 is readily done using a longitudinally segmented mold over the inner steel layer 108 and injecting the composite resin and short fiber mix into the formed cavity. In general, a mold with four to six segments should be enough since the casting material to be used is intended to be relatively elastic and the segment extraction, even with 3-4 segments, faces minimal interference.

For mortars constructed with shells of the type shown in FIG. 1, upon detonation, the dynamic expansion of explosive gasses would disintegrate the outer carbon fiber composite layer 102 of the shell 100 into small harmless fibers as was shown in the studies known in the art. The tearing and relative disintegration of the exterior carbon fiber layer 102 will be coupled with the propulsion forces from the dynamic expansion of the detonation gasses to eject the preformed fragments 104 radially outwards. The proposed enhanced aerodynamic formed fragments 104 can potentially significantly increase the area of effectiveness of the detonation zone, as less drag correlates to greater travelled distances. Factors to consider to maximize the initial velocity of the formed fragments 104 include the configuration of the shell assembly; the orientation in which the fibers of the composite materials are wound; the underlying mechanics in which carbon-fiber composites fragment via dynamic expansion loading; and the dynamics in which the fragments travel as a function of shape.

To make an estimate for shell weight reduction together with the formed fragments, a 120 mm round of the MAPAM round type is considered and its dimensions are extrapolated to be structurally appropriate for a 120 mm round with an estimated 7200 preformed fragments in an epoxy housing. With these estimates, the thickness of the exterior metallic casing becomes 3 mm and the epoxy matrix containing the preformed fragments need to be 7 mm in thickness with 4.2 mm diameter spherical fragments. The shell body based on these parameters is estimated to be 14.6 lb. The internal components of the mortar, including its high explosive charges are estimated from a current mortar to be around 15 lb. Therefore, the overall weight of a 120 mm MAPAM type round is expected to be around roughly 29.6 lbs. With preliminary calculations, the proposed design shown in FIGS. 1, 2*a* and 2*b* with a continuous outer carbon-fiber composite shell thickness of 1.5 mm to 3.5 mm (1.5 mm thickness is determined to be sufficient due to the presence of the crossed ribs) is estimated to become 20-24% lighter than a similar conventional round.

Hybrid Carbon-Fiber Composite and Metallic Fragmentation Shell

Controlled fragmentation of metals can be engineered by machining or forming a grid system into the outer surface of a warhead shell to provide a pattern of stress concentration along which the outer shell would fracture to form fragments prescribed by the grid geometry. However, since the machined grid system weakens the shell structure, the shell needs to be relatively thick, i.e., significantly heavier than a plain shell, to resist the firing acceleration shock loading. Alternatively, the round can be provided with a separate shell to provide the required structural strength to withstand the firing shock loading. In both cases, however, the weight of the munitions shell is increased and it would also occupy a larger volume as compared to conventional shells. Thus, the munitions range as well as its lethality is reduced.

Another embodiment of composite munitions shell 200 can overcome both of such shortcomings, i.e., significantly reduce the total weight of munitions with fragmentation shells and do so with less total shell volume. Such shell embodiment is shown in FIG. 3*a*. A close-up cross-sectional view of the shell design of FIG. 3*a* is shown in FIG. 3*b*.

As can be seen in the cutaway section of FIG. 3*a*, the shell 200 is constructed with an inner layer 202 that is provided with a machined or formed fragmentation pattern on its outer surface. As was previously indicated, the grid system weakens the shell structure. Carbon-fibers with their binding resins 202 are laid in the groove patterns to form a matrix to add the required strength to the shell 200 to withstand the firing acceleration induced shock loading. Then as the provided groove patterns are filled, a relatively thin layer of carbon-fiber composite layer 206 is wound over the shell to provide an outer layer of composite shell as shown in FIGS. 3*a* and 3*b*. The shell 200 defines an interior space 208 for of the mortar, for accommodating various components, such as explosive charges.

For mortars constructed with shells of the type shown in FIG. 3*a*, upon detonation, the dynamic expansion of explosive gasses would disintegrate the outer carbon fiber composite layer 206 of the shell 200 into small fibers as was described above. The tearing and relative disintegration of the exterior carbon fiber layer 206 will be coupled with the propulsion forces from the dynamic expansion of the detonation gasses to fracture the metallic layer 202 along the provided grid grooves and eject the preformed fragments of the pattern radially outwards. It is appreciated that the carbon-fiber composite 204 is laid longitudinally in the fragmentation shell grooves. Therefore, they provide minimal resistance to the fracture of the shell due to the detonation generated internal pressure. In addition, the tensile strength of these carbon fibers would assist in concentrating tensile stress between the fragments as the internal pressure rises.

Figure 3B:
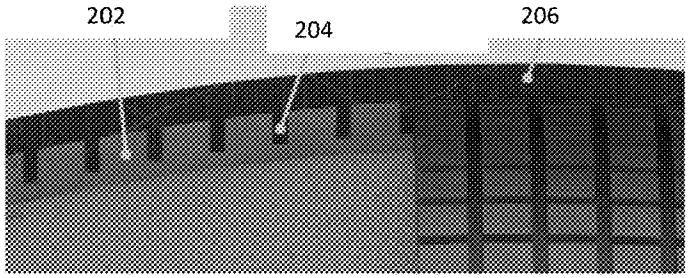
FIG. 3*b* illustrates a cross-sectional view of the composite shell of FIG. 4*a*.
Figure 3A:
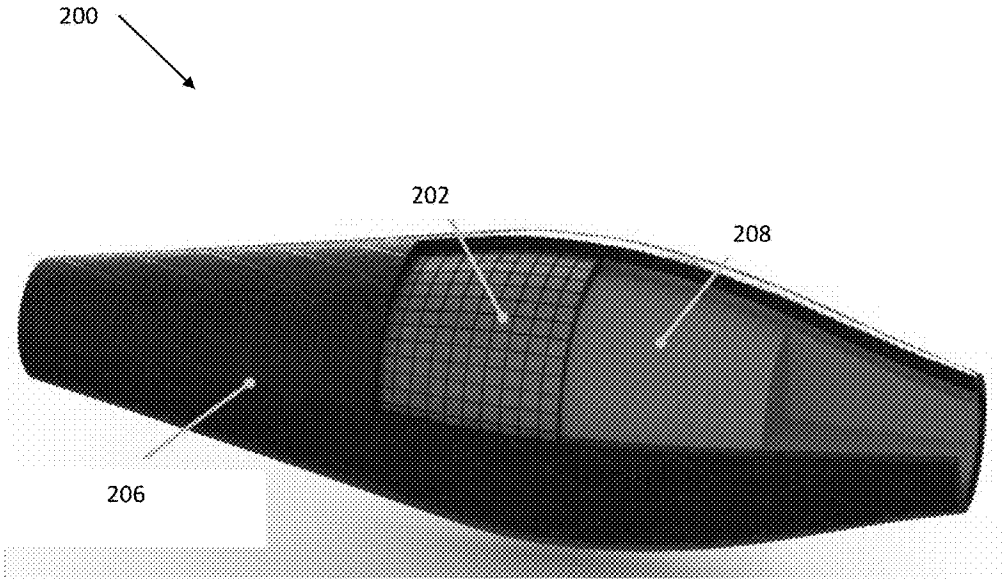
FIG. 3*a* illustrates an embodiment of metallic formed fragments with carbon-fiber composite matrix for firing shock survivability.
Figure 4A:
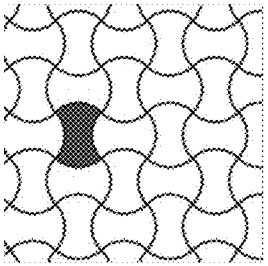
FIGS. 4*a*-4*f* illustrate variations of repeating and interlocking formed fragmentation patterns that provide firing shock load bearing capability.
Figure 4B:
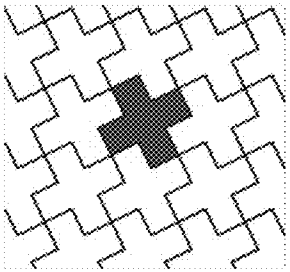
Figure 4C:
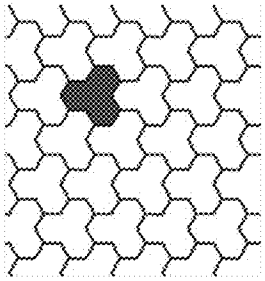
Figure 4D:
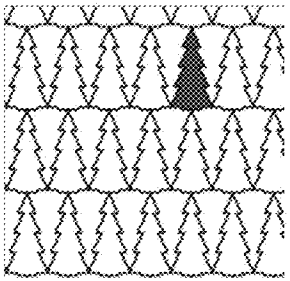
Figure 4E:
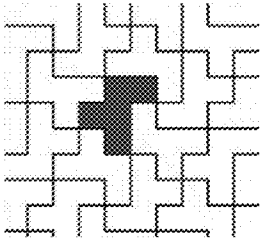
Figure 4F:
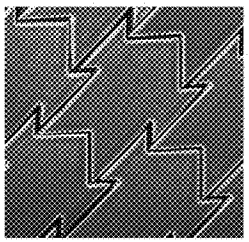

Finite Element Analysis FEA of a Finite Element (FE) model of a section of the fragmentation shell 200 of FIGS. 3*a* and 3*b* show the grooves and carbon-fiber matrix are at an elevated state of stress at the provided grid grooves. Thus, the fragmentation shell can be expected to fail along these seams under the conditions exhibited during dynamic internal pressure following detonation of the high explosive charges.

It is noted that the firing acceleration shock loading is primarily compressive due to the firing setback acceleration, with a certain level of set-forward related tensile loading and the effects of stress wave reflection (the so-called ringing). It is also noted that various materials, such as glass powder can be added to the carbon-fiber binding resin to vary its stiffness to minimize discontinuity of the metallic shell due to the provided grooves. It is also appreciated that the groove pattern and the size and geometry of the grooves with the carbo-fiber composite filling can be optimized to maximize the shell resistance to firing shock loading, while minimizing its overall mass and volume. The aerodynamic characteristics of the formed fragments must also be considered.

In the shell 200 of FIG. 3*a*, the grid pattern is shown to be a square shape for the sake of illustration simplicity. The optimal grid pattern maximizes the shell resistance to firing shock loading with minimal overall mass and volume, while considering the aerodynamic characteristics of the formed fragments for low aerodynamic induced drag forces.

An estimated mortar shell weight reduction with the shell 200 FIGS. 3*a* and 3*b* considers 70 spaced grooves along the length and 50 radial grooves in the steel fragmentation layer 202 that are 2.5 mm deep and 2 mm, the round should provide around 3500 fragments upon detonation. The grooves are filled with the carbon-fiber composite material 204 and with outer carbon-fiber composite shell 206 having a thickness of 1.5 mm to 3.5 mm (1.5 mm thickness is determined to be sufficient), the mortar is estimated to become 21-25% lighter than a similar conventional round.

Metallic Fragmentation Shells with Firing Shock Loading Resistant Patterns

The grid pattern FIG. 3*a* is shown to be square shaped. Such grid shape provides the means of generating stress concentration along the grid lines and therefore cause the shell fragmentation in the prescribed grid pattern under internal pressure of the following detonation of the high explosive charges. Such grid pattern, however, also makes the fragmentation shell weak to compressive loading due to firing setback acceleration. As a result, the fragmentation shell must either be provided with a relatively thick ungrooved back section to provide the required strength, or must be provided with an external continuous shell such as that shown in FIG. 3*a*. A round provided with formed fragments, such as those shown in FIG. 1, do not provide any support to either compressive or tensile loading of the shell.

Recognizing that the firing acceleration shock loading is primarily compressive due to the firing setback acceleration, if the added outer shells, such as those fabricated by carbon-fiber composites as shown in FIGS. 1 and 3*a*, can withstand the tensile stresses that the munitions shell is subjected to during the firing, the fragmentation shell can be designed to only resist the compressive loading of the shell. Such compressive-load-bearing fragmentation shells will significantly reduce the total mortar and other similar munitions shell weight and in many cases also volume. Such compressive-load-bearing fragmentation shells cannot be constructed with grooved grids, but constructed with individual formed fragments that are assembled into a shell. The individual formed fragments, however, can be "interlocked" so that the constructed shell can withstand compressive loading. Such structures are readily constructed by fragment geometries that consist of repeated patterns and are also interlocking. It is noted that fragments shapes, such as diamond shaped fragments (like those shown in FIG. 1 but without the grid grooves and backing material, i.e., individual diamond shaped members) can be used to form a shell structure but cannot support any compressive or tensile loading. Numerous repeated and interlocking fragment shapes are possible, a few of which are shown in FIGS. 4*a*-4*f*. It is also appreciated that similar patterns, repeating and non-repeating patterns may also be designed to provide structures with both compressive as well as tensile load bearing capability. In practice, the interlocking fragments are held together during assembly by light adhesives and provided with thin inner shell for structural stability during assembly.

Drag-Reducing Surface Dimple Patterns with Spin Inducing Capability

Figure 5:
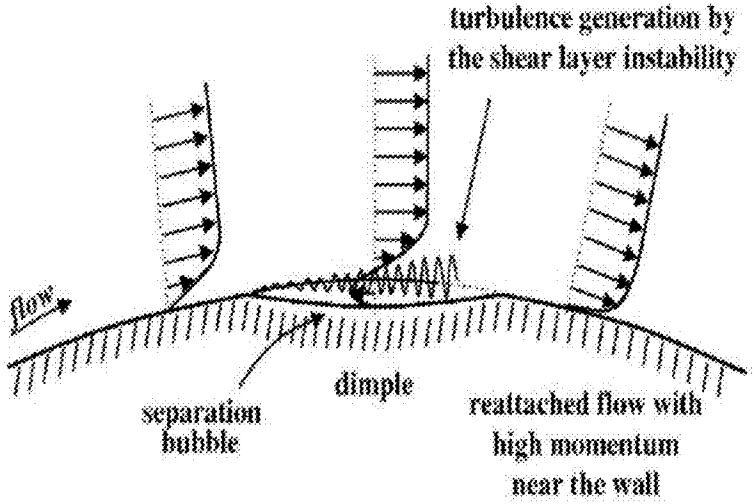
FIG. 5 illustrates a mechanism of drag reduction with surface dimples.
Figure 6:
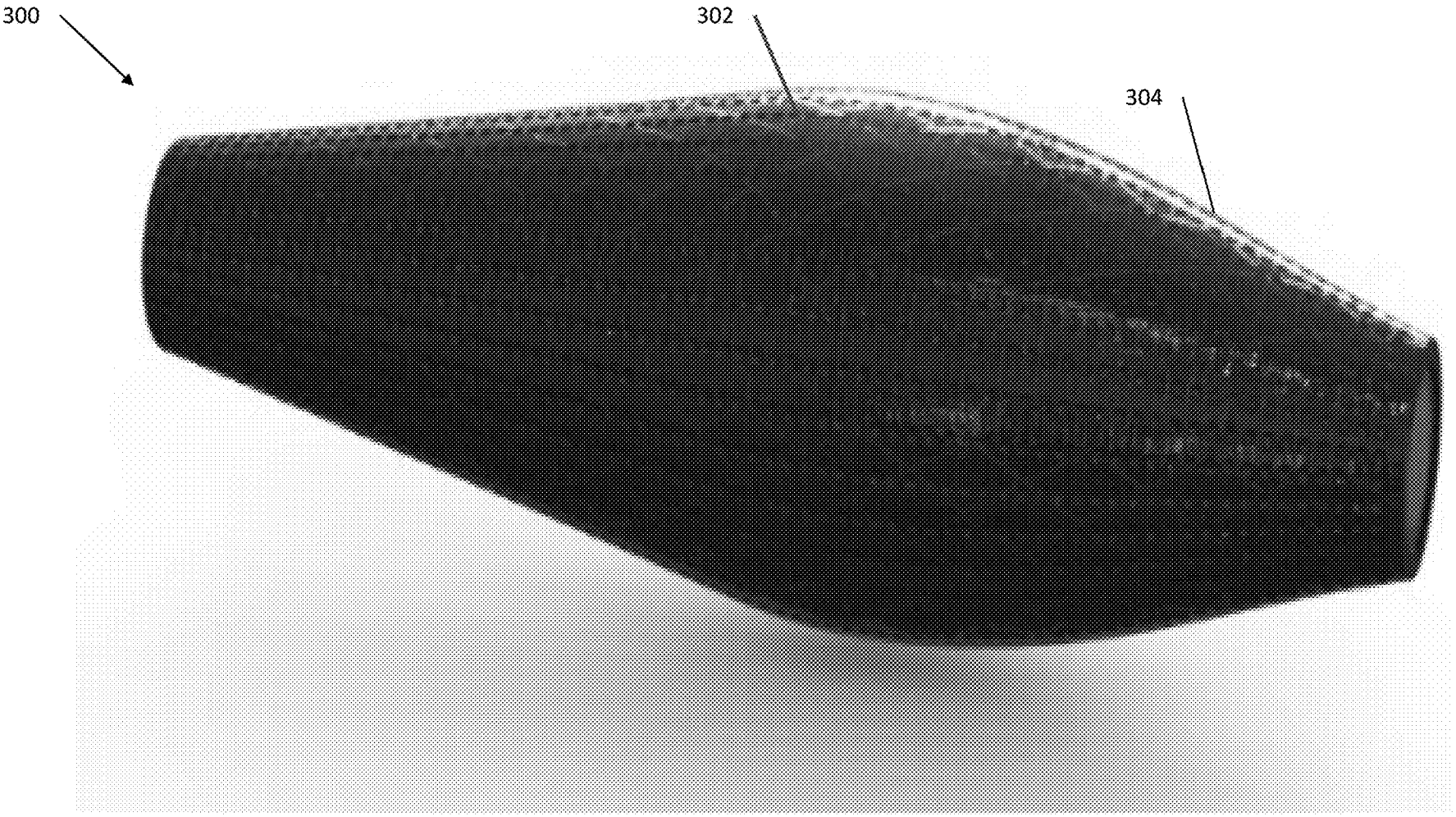
FIG. 6 illustrates a mortar shell with an exemplary drag reducing surface dimple pattern.

The embodiments described above have a goal of reducing the weight of the mortar shell and thereby reducing the overall weight of the mortar while providing the means of achieving formed fragmentation. The exit velocity of the round, thereby its range, can be increased for a given propulsion charge. The embodiment of FIGS. 5 and 6 is provided to reduce aerodynamic drag forces acting on the mortar, thereby increasing the range of the mortar even further. To this end, the exterior carbon-fiber composite casing of the embodiments described above can be covered by arrays/patterns of dimples, like to those provided on golf balls, to optimize the aerodynamics drag acting on the shell body during the flight. In addition, the dimple pattern can be configured such that the air flow pattern over the round surface would generate the desired net spinning torque to increase the round stability and precision.

The significant types of drag forces acting on a body such as a sphere or a mortar round during the flight are skin and shape drags. The skin drag is dependent on the exterior shell body material and the friction as it interacts with the air in flight. Skin drag can be minimized by modeling and computational methods and testing different types of carbon-fiber composites to optimize the surface roughness of the exterior shell body structure. The shape drag is caused when the flow of air around the mortar body separates and forms what is known as a wake, which results to lower pressures behind the body. In the present embodiment, the shape drag is intended to be minimized by implementing an array/pattern of dimples on the external surface of the mortar to increase turbulence as the mortar travels in flight.

The use of dimple patterns on the surface of golf balls have been studied and optimized to control parameters such as launch velocities, angles, and the rate of spin upon impact. In a historical sense, dimples have been spherical in shape but alternative designs have been seen to feature hexagonal patterns as well. The mechanism of drag reduction can be explained as the presence of the dimples induces a turbulent boundary layer on its surface, see FIG. 5. This turbulent layer flow has a larger momentum compared to laminar boundary layer flow and thus delays the flow separation. Therefore, the presence of dimples is known to reduce the drag coefficient by over 50%, however, this metric is highly dependent on the diameter and depth of the dimples in golf balls.

The reduction of drag force due to the placement of dimples has sparked research efforts for alternative aerospace applications, such as on wing planforms to increase operating efficiencies in commercial wing designs. The process of delaying the flow separation of a wing planform has been proposed with the implementation of dimples at optimized locations on the mid-wing airfoil of a Boeing 737. Using computational fluid dynamics analysis, it can be shown that the presence of inward dimples created a strong suction force that kept the boundary layer attached and delayed the separation of flow to ultimately reduce the pressure drag exerted onto the modelled structure.

Based on the stated findings, a mortar shell body constructed with carbon fiber composites (via filament winding, prepreg, or vacuum assisted resin transfer molding) to have an array of dimple patterns to reduce drag during flight, thereby increasing the mortar range of coverage. The dimple patterns may be provided on any of the mortar shell concepts described above. A mortar shell 300 having a dimple pattern 302 on an exterior surface 304 thereof is shown in FIG. 6.

Obturating Ring Friction Reduction

The mortar is a muzzle loaded weapon system that requires the mortar bomb to slide down a smooth bore before striking a firing pin located at the base of the tube to detonate the cartridge. To optimize the propulsion forces acting on the bomb, an obturating ring is placed around a groove that has been machined onto the conventional metallic casing of the mortar shell body. The ring deforms to seal the propellant gases, reduce dispersion, and ensures repeatable muzzle velocities to create an efficient propulsion system. Obturating rings found on modern mortar rounds are constructed of an amorphous thermoplastic polymer known as polycarbonate, and are assembled onto the shell body as a split ring. The muzzle velocity can be increased by reducing barrel friction with the obturating ring by improving upon the conventional plastic polycarbonate by compounding it with solid lubricants such as molybdenum disulfide ($MoS_2$), polytetrafluoroethylene, or graphite. Materials compounded with solid lubricants are often shown to have a reduced coefficient of friction due to the low interfacial shear strengths between two materials under dry conditions. It has been shown that polycarbonate compounded with $MoS_2$ exhibits lower coefficient of friction and also improves upon the wear resistant nature between the interfaces of two materials moving relative to each other. The addition of such materials can potentially optimize the range of coverage by reducing friction to increase muzzle velocity, and prolong the service life of mortar tubes in the field.

Capability to Integrate Components into the Composite Shell

The use of a carbon-fiber composite in the construction of munitions shell provides for relatively easy integration of certain components of the munitions into the structure of the shell by inserting them into the mandrel over which the shell fibers are to be wound, providing a highly secure attachment to the shell structure without the need of secondary costly and space occupying brackets and fasteners. This capability is particularly suitable for components that are to be mounted onto the munitions shell such as actuations devices used to provide terminal guidance capability to increase targeting precision.

Figure 7:
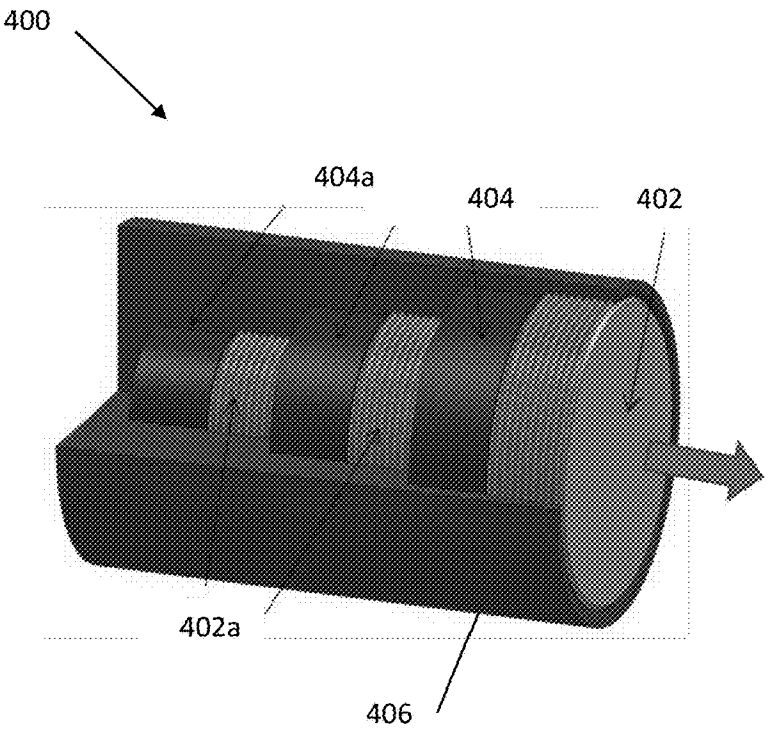
FIG. 7 illustrates a multi-stage slug-shot impulse guidance and control actuator for use with a munitions shell.

As an example, consider a multi-stage slug-shot impulse guidance and control actuator 400 as shown in FIG. 7. The actuator 400 is configured to generate very short duration impulses. In the multi-stage slug-shot actuator 400, the endmost (largest) slug 402 is ejected by igniting the charge 404 behind it (initiator not shown for sake of clarity). The pressure of the burning propellant will rise until the threads which engage the plug 402 to the housing tube 406 fail, allowing the slug 402 to be ejected (shot) and the high-pressure propulsion charge to flow into the lower-pressure surrounding atmosphere, thereby generating a very short duration and high amplitude impulse. The two remaining charges 404*a* are protected against sympathetic initiation by the second (middle) threaded slug 402*a*. When the next slug 402*a* is commanded to fire, the process will be identical to that of the first slug. The second slug's 402*a* smaller diameter will ensure that the second slug 402*a* does not have a long path of mangled threads to interfere with its exit path. The third slug 402*a* is fired similarly on command. It is noted that the main purpose of the thread is to ensure that pressure and temperature builds up behind each slug following ignition of the charges and thereby increasing the speed of burn and increasing the level of generated impulse. The actuator can also be configured in a one-shot impulse actuation device configured for pulsed actuation for terminal guidance where close to 0.5 inch diameter slugs were shown in actual tests to be capable of providing 10 N-sec to 140 N-sec for up to 2 milliseconds. In this example, the body of the multi-stage slug-shot and the firing wires may first be positioned inside the provided pockets in the mandrel used for carbon-fiber winding, and the composite layer laid over the mandrel. Alternatively, an assembly pocket is formed in the composite shell by providing the appropriate inserts into the mandrel, and the actuator is then mounted into the provided pocket.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A mortar shell comprising:

a metallic inner layer defining an interior of the mortar;

a polymer outer layer, the polymer outer layer having reinforcing fibers dispersed therein; and at least one layer of metallic fragments disposed between the inner and outer layers such that the at least one layer of metallic fragments are disposed at a boundary between the metallic inner layer and the polymer outer layer in a repeating array pattern, the at least one layer of metallic fragments comprising a plurality of individual metallic fragments which are unconnected to each other;

wherein the polymer outer layer comprises a plurality of concavities formed on an inner surface in the repeating array pattern, the plurality of concavities corresponding to the plurality of individual metallic fragments such that at least a portion of each of the plurality of individual metallic fragments are disposed within a corresponding one of the plurality of concavities; and the mortar shell further comprising a polymer inner layer formed separately from the polymer outer layer, the inner layer being disposed between the metallic inner layer and the at least one layer of metallic fragments, the polymer inner layer comprises a plurality of concavities formed on an outer surface in the repeating array pattern, the plurality of concavities corresponding to the plurality of individual metallic fragments such that at least a portion of each of the plurality of individual metallic fragments are disposed within a corresponding one of the plurality of concavities.

2. The mortar shell of claim 1, wherein at least some of the plurality of individual metallic fragments are spherical in shape.

3. The mortar shell of claim 1, where the polymer outer layer comprises a pattern of dimples formed on an outer surface.

4. The mortar shell of claim 1, where the polymer outer layer comprises a solid lubricant.

* * * * *